US005921450A

United States Patent [19]

Robinson

[11] Patent Number: 5,921,450

[45] Date of Patent: Jul. 13, 1999

[54] TAPE DISPENSER

[76] Inventor: Lafayette Robinson, 302 Clinton Ave., Brooklyn, N.Y. 11205

[21] Appl. No.: 08/972,590

[22] Filed: Nov. 18, 1997

[51] Int. Cl.[6] ..... B65B 13/22; B65H 35/07

[52] U.S. Cl. ..... 225/56; 225/25; 225/56; 225/88; 156/579

[58] Field of Search ..... 225/25, 51, 52, 225/56, 65, 66, 80, 82, 84, 85, 88, 90; 156/523, 527, 579; 140/93.4; 493/353

[56] References Cited

U.S. PATENT DOCUMENTS

| | | | |
|---|---|---|---|
| 2,424,488 | 7/1947 | Morin | 225/25 |
| 2,434,776 | 1/1948 | Cleef et al. | 225/25 |
| 2,534,691 | 12/1950 | Zabel | 225/25 |
| 2,676,765 | 4/1954 | Kaplan | 225/88 |
| 3,707,251 | 12/1972 | Dashier et al. | 225/88 |
| 3,725,182 | 4/1973 | Regan | 156/579 |
| 4,096,021 | 6/1978 | Pool et al. | 156/579 |
| 4,447,281 | 5/1984 | Joy . | |
| 4,623,421 | 11/1986 | Cardin | 156/579 |
| 4,915,769 | 4/1990 | Heil et al. | 156/579 |
| 5,071,051 | 12/1991 | Corbo et al. | 225/88 |
| 5,174,850 | 12/1992 | Stefan . | |
| 5,236,540 | 8/1993 | Shi . | |
| 5,310,445 | 5/1994 | Tucker | 156/579 |
| 5,380,395 | 1/1995 | Uchida | 156/579 |
| 5,393,367 | 2/1995 | Yu Chen | 156/579 |

*Primary Examiner*—Rinaldi I. Rada
*Assistant Examiner*—Gyounghyun Bae
*Attorney, Agent, or Firm*—Kane, Dalsimer, Sullivan, Kurucz, Levy, Eisele and Richard, LLP

[57] ABSTRACT

A tape dispenser for dispensing adhesive tape which includes a mechanism for preventing roll back of tape on the roll after dispensing thereon through the use of a roller biased or configured to rotate in one direction or otherwise to prevent the tape being dispensed from reattaching to the roll or providing the roll itself with unidirectional operation.

4 Claims, 4 Drawing Sheets

TAPE DISPENSER

FIELD OF THE INVENTION

The invention relates to a tape dispenser which includes a means for preventing a roll of tape being dispensed from retracting upon itself after a portion thereof is dispensed.

BACKGROUND OF THE INVENTION

The present invention deals with tape dispensers typically of which are used in sealing boxes and other packaging. The dispensers typically include a handle and a roller upon which a roll of tape is supported and allowed to rotate. The end of the tape extends to a portion which includes typically a serrated edge which allows the tape that's been dispensed to be cut at that point.

An annoying and reoccurring problem with such dispensers is that upon dispensing the tape the roll, due to centrifical force etc., the roll continues to rotate and causes a portion of the tape to roll back upon itself. The user then must separate this portion of the tape from the roll which is difficult and cumbersome.

It appears that a reason why a portion of the tape re-adheres to the roll is that the adhesive portion of the tape which contacts the tabs of the dispenser just prior to the serrated edge does not have sufficient surface to prevent the tape from retracting upon itself.

Accordingly there exist a need to improve the operation of such dispensers so that they are more user friendly and less cumbersome to use and avoid the disadvantage of continuously having to separate the tape which has reattached itself to the roll.

SUMMARY OF THE INVENTION

It is therefore a principal object of the invention to avoid having a portion of the tape roll back upon itself upon dispensing of the tape.

It is a further object to provide for such a feature in a simple and effective manner and one which can be readily implemented in typically used tape dispensers.

It is a further object to provide for such a feature on a tape dispenser which is simple yet effective and economical.

These objects and advantages will be realized by the present invention's use of a roller bar mechanism positioned adjacent to the dispensing portion of the tape dispenser. In this regard the roll of tape is maintained on a main frame about which it rotates. The tape being dispensed then passes over a support mechanism out to a serrated edge which serves to cut the tape being dispensed. Typically a portion of the tape remains exposed between the mother roll and the serrated edge so that the user can then apply the tape to the package directly and extracted to the extent necessary from the mother roll. The present invention provides for means of preventing the tape remaining between the mother roll and the serrated cutting portion from rolling back upon the mother roll which is undesirable. It does so by providing a roller bar between the main or mother roll and the serrated edge with the tape passing over the roller bar before reaching the serrated edge. The roller bar provides sufficient tension upon the tape passing there over to prevent it from rolling back upon the main roll. The roller bar comprises a cylinder having an internal ratchet arrangement so as to make the necessary tensioning of the roller bar so that it rotates in a manner desired i.e. being a controlled rotation. Another version of the present invention utilizes a roller bar which may be mounted on a shaft which is located in a slot member maintaining the roller bar in one position upon dispensing but should the tape attempt to retract upon itself cause the roller bar to retract in the slot preventing further movement of the tape back upon itself.

An alternative roller bar would be one that is somewhat triangular or trapezoidal in shape and may be similarly be positioned in this slotted arrangement which again would engage the tape to prevent it from retracting upon itself once the desired portion has been dispensed.

Alternatively, the main or mother roll itself may itself include a ratchet arrangement wherein the internal portion of the support includes such a ratchet means to prevent the main roll from freewheeling causing the undesirable effect of having a portion of the tape adhere to itself. This ratchet arrangement could be of course used in conjunction with the roller bar mechanism previously discussed.

BRIEF DESCRIPTION OF THE DRAWINGS

These and other objects and advantages will be realized by the present invention the disclosure of which should be taken in conjunction with the drawings wherein.

DETAILED DESCRIPTION OF THE PREFERRED EMBODIMENT

Figure 7:
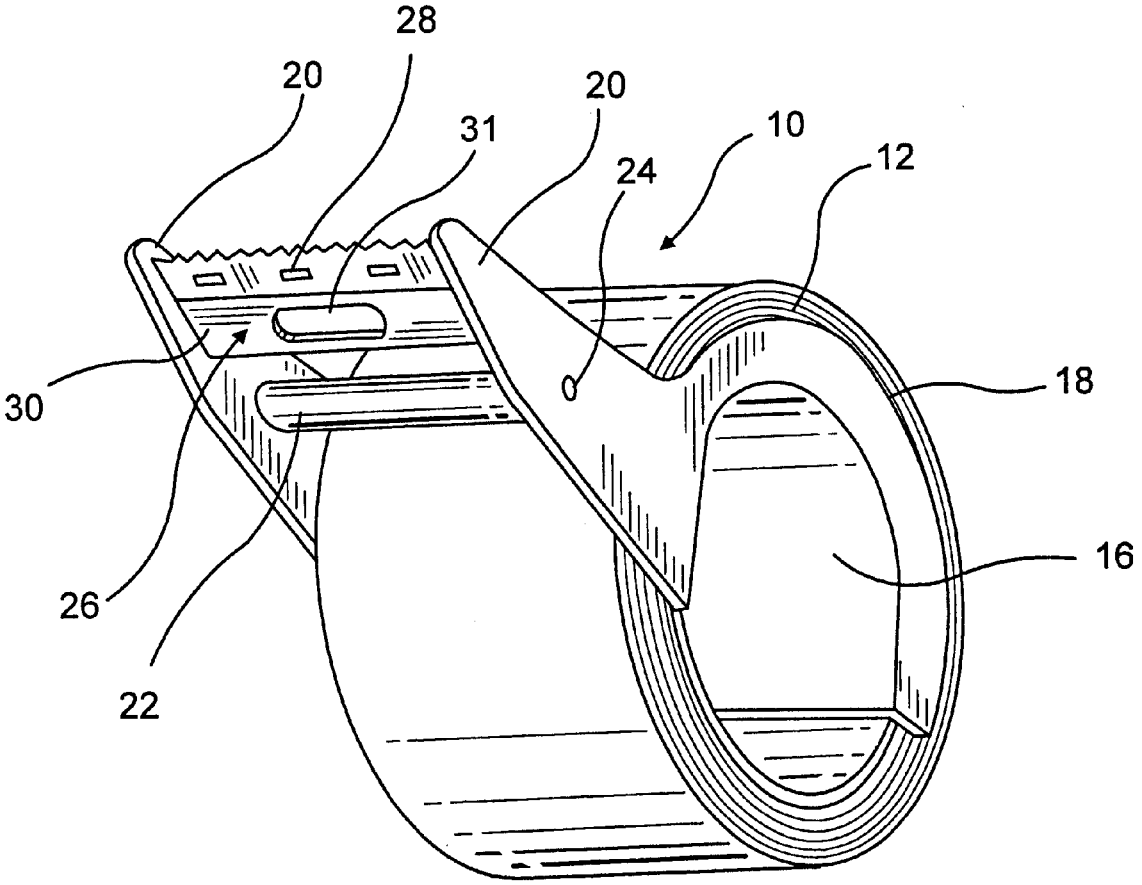
FIG. 7 is a perspective view of the tape dispenser hating the roller bar incorporating the teachings of the present invention.

Turning now more particularly to the drawings, there is shown a tape dispenser 10 for dispensing an adhesive tape 12 which is maintained typically, on a cardboard or plastic roll 14. The dispenser includes a semi-circular portion 16 with flanged ends 18 between which the tape 12 is positioned for dispensing. The tape 12 is supported by the dispenser 10 and rotates about portion 16 upon dispensing. As can be seen clearly in FIG. 7, the dispenser 10 includes oppositely positioned parallel arms 20 which extend from flanges 18. Supported by and positioned between these arms 20 is a roller 22 which rotates about a spindle 24 which engages the flanges 18.

Further out on arms 20 is positioned a cutting mechanism 26 comprising a flat shelf portion 28 supporting a serrated edge 30. An opening 31 is provided in portion 28 to allow one's to insert one finger therethrough to press the tape thereunder onto the surface it is being applied, to initiate the drawing of the tape from roll 14.

Alternatively, or in conjunction therewith, a flap extension 32 may be provided to facilitate the pressing of the drawn tape on to a package or other surface as desired. In the absence of the flap 32 or in addition thereto, the user, by holding arms 20 and placing ones fingers therebetween can initiate the dispenser by pressing the tape which is in this space onto a surface and pulling back on the dispenser.

Once the tape is applied initially to a surface drawing back on the dispenser allows additional tape to feed off the roll 14 as desired. The serrated edge 28 is then used to cut the tape 12.

As previously discussed, a continuing problem is that once the tape is cut it often tends to draw back onto the roll due to the tensioning of the tape during dispensing or the combined freewheeling rotation of the roll 14. This requires the user to then detach the tape drawn back and to position it properly.

In this regard, the present invention provides for a way of preventing this undesired draw back and brakes the reverse action of the tape.

Figure 1:
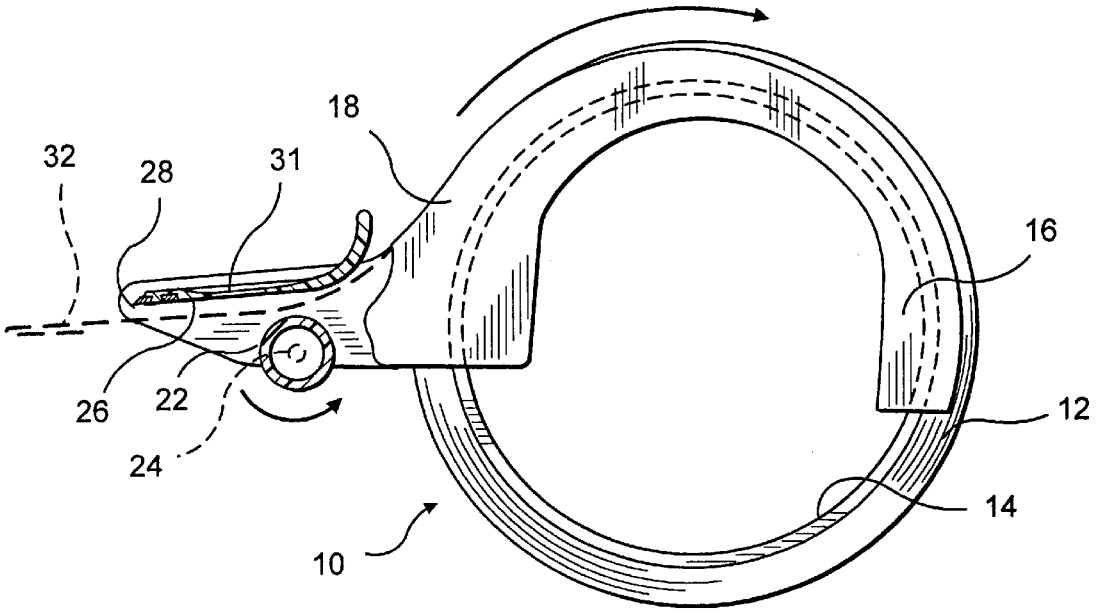
FIG. 1 a side elevated view of the tape dispenser having the roller bar incorporating the teachings of the present invention.

As shown in FIG. 1, the path of the tape 12 is illustrated in the dotted line. As the tape 12 comes off roll 14 it passes over roller 22 with its adhesive side in contact therewith. Roller 22 rotates as the tape is being dispensed there over. To initiate initial dispensing, the tape may include an elongaged tab portion 23 made of cardboard or the like attached at the end and passing over roller 22 having language thereon to the effect—pull here to start. Pulling the tab 23 results in pulling the tape over roller 22 whereupon the tab can there be detached and discarded.

Figure 2:
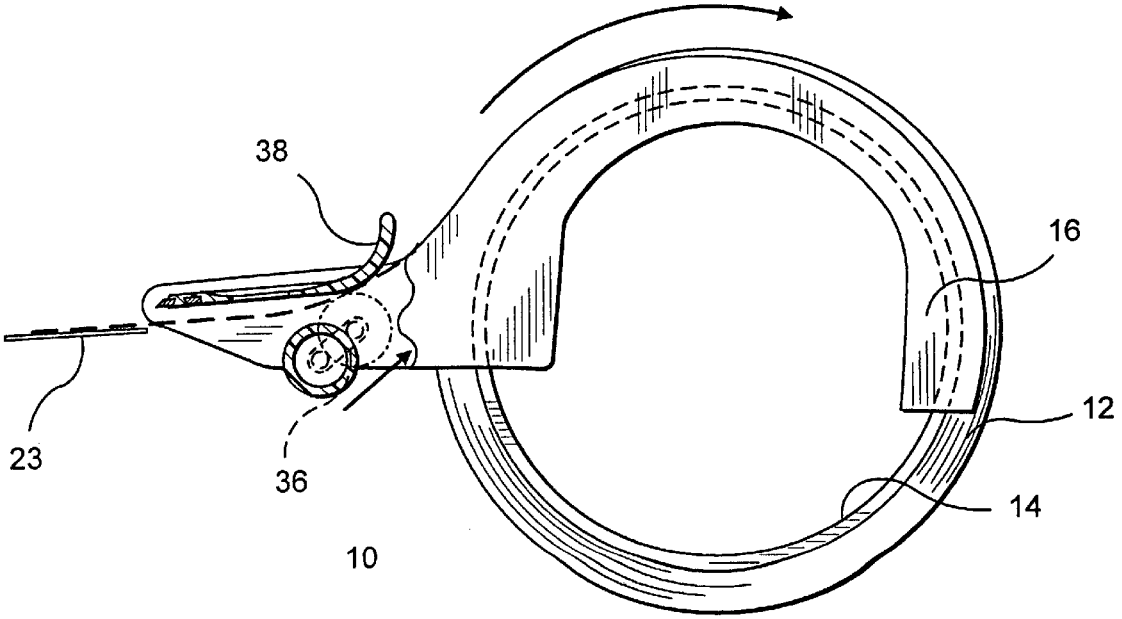
FIG. 2 is a side elevational view of the tape dispenser showing the roller bar in a slotted arrangement incorporating the teachings of the present invention.
Figure 4:
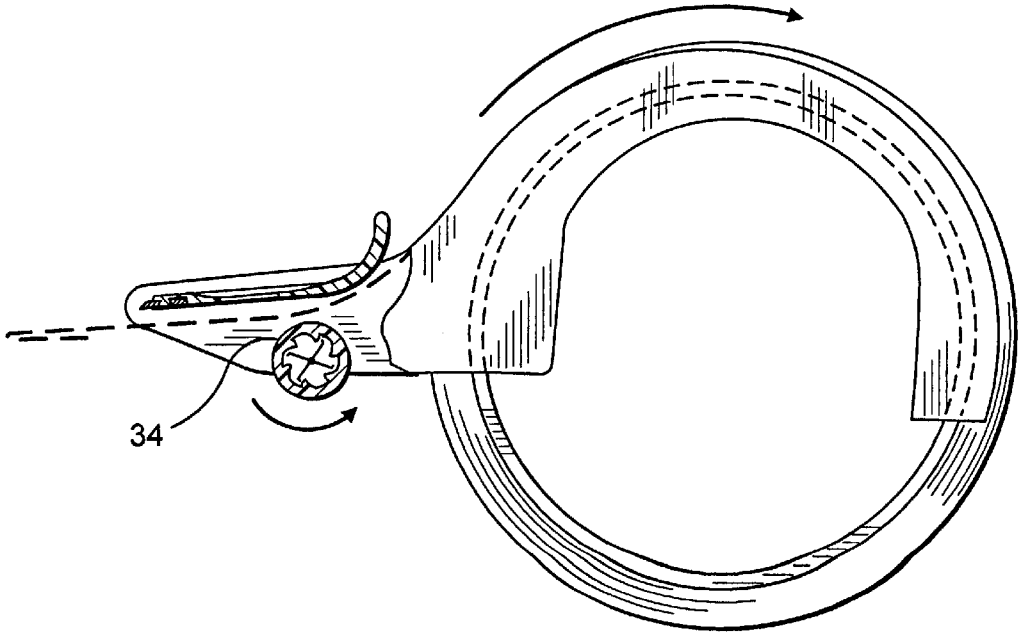
FIG. 4 shows a tape dispenser similar to that shown in FIG. 1 with, however, a roller bar having an internal rachet configuration.

To prevent drawback roller 22 is used to absorb any draw back force and thus prevent the tape from doing the same. The roller 22 can be uni-directional by way of a ratchet mechanism 34 in that it is rotatable only in a counter-clockwise direction as shown in FIG. 4. This will prevent the tape in contact with it from drawing back onto the roll 14. Roll 22 can also be spring biased toward such a rotation or positioned in a slot 36 as shown in FIG. 2 as to absorb any force backwards of the tape and thereupon preventing draw back. Upon dispensing, the roller 22 would be forced forward. Once the tape is cut it would retreat backwards forcing the tape against a guide shaped portion 38 absorbing the tension of the tape and preventing draw back.

Figure 3:
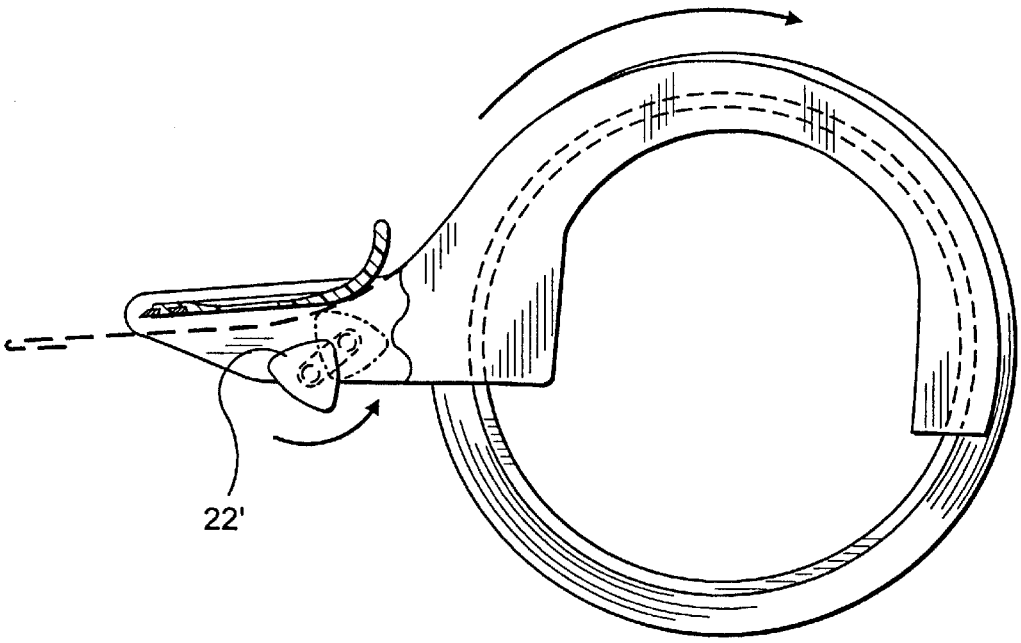
FIG. 3 shows a side elevational view of a tape dispenser similar to that shown in FIG. 2, however, with a roller bar which is non-cylindrical in shape.

Alternatively, the roller 22 can be trapezoidal shape 22' as shown in FIG. 3 which would supply an increased engagement of the tape with the roller 22 during draw back.

In either case it may be desirable to bias the roller into the rearward position by perhaps spring loading it or using a metal roller and a magnetized guide 38 or vice versa. Alternatively, the roller 22 could be filled with a dampening gel to inhibit its rolling back.

Figure 5:
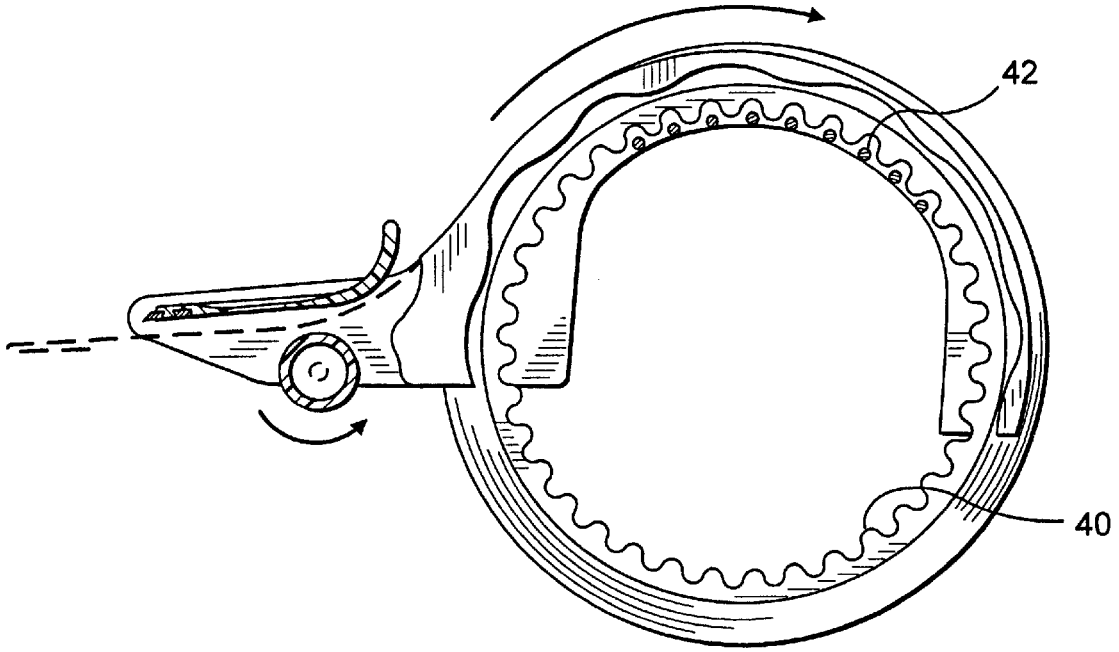
FIG. 5 is a side elevational view of a tape dispenser having a roller bar and, in addition, a main roll having an internal ratchet mechanism incorporating teachings of the present invention.
Figure 6:
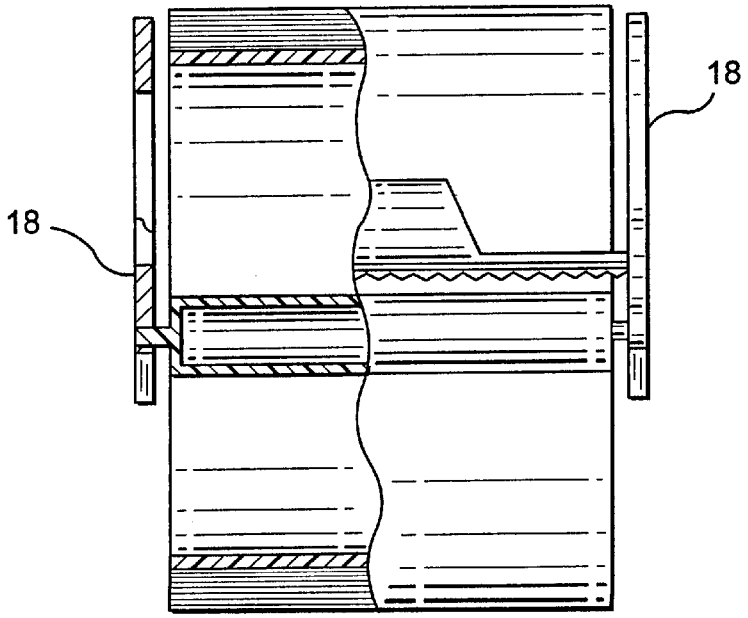
FIG. 6 is a front somewhat sectional view of the tape dispenser having the roller bar incorporating the teachings of the present invention.

Another method of preventing draw back is shown in FIG. 5. In this regard, the roll 14 may include a notch type or corrugated surface 40 which is engageable with edges 42 positioned on portion 16. This design will allow the tape to be dispensed while inhibiting the tape roll from reverse rotation so as to prevent draw back.

The entire dispenser may be made of plastic or pressed cardboard and may be disposable in nature.

Accordingly, thus, by the present invention, its objects and advantages are realized and although preferred embodiments have been disclosed and described in detail herein, its scope should not be limited thereby rather its scope should be determined by that of the appended claims.

What is claimed is:

1. A hand held apparatus for dispensing adhesive tape comprising:

tape roll dispensing body for supporting body for supporting and maintaining a roll of adhesive tape thereon, said dispensing body being circular in shape;

support arms extending out and away from said body and aligned parallel with each other at a spaced distance therebetween;

said dispensing body and support arms being integrally constructed;

cutting means supported by and extending between said arms for cutting tape being dispensed;

means for preventing the drawing back of tape onto a roll of tape supported by the body comprising a substantially trapezoidal shaped roller supported by said arms, said roller being perpendicular to tape being dispensed, said means being engageable with the tape to compensate for tensioning thereon and movement of the roll during dispensing so as to prevent roll back of tape upon the roll upon termination of dispensing tape therefrom;

said roller includes means that allow it to rotate in a first direction due to movement of tape being whilst being inhibited from movement in a second direction opposite to the first direction; and said arms include respective slots and Support a guide member, said roller is supported in said slots at each end and is movable between a forward position in the slot where it is farthest from the guide member during dispensing of tape and a rearward position upon termination of dispensing at which time it engages the guide member with tape therebetween to prevent draw back of tape.

2. The invention in accordance with claim 1 wherein said roller means includes a ratchet means which allows it to rotate only in the first direction.

3. The invention in accordance with claim 1 wherein said body includes a portion engageable with a surface of a roll of adhesive tape so as to inhibit the roll of tape from rotating in a direction opposite of that in which it rotates during dispensing tape.

4. The invention in accordance with claim 3 which includes ratchet means engageable with the body of the roll of tape to inhibit the reverse rotation thereof.

* * * * *